US007984907B2

(12) United States Patent
Chen

(10) Patent No.: US 7,984,907 B2
(45) Date of Patent: Jul. 26, 2011

(54) AUTOMATIC FEEDER WITH SEPARABLE TRANSMISSION GEARS AND IMAGE ACQUIRING APPARATUS

(75) Inventor: Ku Ming Chen, Hsinchu County (TW)

(73) Assignee: Avision Inc. (TW)

( * ) Notice: Subject to any disclaimer, the term of this patent is extended or adjusted under 35 U.S.C. 154(b) by 0 days.

(21) Appl. No.: 12/980,016

(22) Filed: Dec. 28, 2010

(65) Prior Publication Data

US 2011/0156346 A1 Jun. 30, 2011

(30) Foreign Application Priority Data

Dec. 30, 2009 (TW) ..... 98145711 A

(51) Int. Cl.
*B65H 5/06* (2006.01)

(52) U.S. Cl. ..... 271/273; 399/124

(58) Field of Classification Search ..... 399/380, 399/124, 125

See application file for complete search history.

(56) References Cited

U.S. PATENT DOCUMENTS

| | | | | |
|---|---|---|---|---|
| 6,536,762 | B1 * | 3/2003 | Sheng et al. | 271/273 |
| 7,448,620 | B2 * | 11/2008 | Ha | 271/265.01 |
| 7,702,276 | B2 * | 4/2010 | Kawashima | 399/380 |
| 2006/0269350 | A1 * | 11/2006 | Koba et al. | 400/691 |
| 2008/0191412 | A1 * | 8/2008 | Tu | 271/273 |

* cited by examiner

*Primary Examiner* — Gerald McClain

(57) ABSTRACT

In an automatic feeder and an image acquiring apparatus, a cover is rotatably connected to a body through a first pin and openable and closable with respect to the body. A roller gear rotates a transporting roller to transport a sheet. An actuating member is attached to the first pin and driven by rotation of the first pin. A middle gear, displaceable by the actuating member, is selectively engaged with a power-output gear and the roller gear so as to transmit a power to the roller gear. An actuating member moves the middle gear to be engaged with the power-output gear and the roller gear when the cover is closed upon the body, and moves the middle gear to be disengaged from at least one of the power-output gear and roller gear when the cover is opened.

20 Claims, 6 Drawing Sheets

AUTOMATIC FEEDER WITH SEPARABLE TRANSMISSION GEARS AND IMAGE ACQUIRING APPARATUS

This application claims priority of No. 098145711 filed in Taiwan R.O.C. on Dec. 30, 2009 under 35 USC 119, the entire content of which is hereby incorporated by reference.

BACKGROUND OF THE INVENTION

1. Field of the Invention

The present invention relates to an automatic feeder and an image acquiring apparatus, and more particularly to an automatic feeder with separable transmission gears and an image acquiring apparatus using such automatic feeder.

2. Related Art

In a conventional automatic feeder, a force for disengaging a motor gear from a transporting roller gear is typically provided by a spring. When a cover is opened with respect to a body, the spring pushes the gear away. In this mechanism, a downward pressing force has to be additionally provided to overcome the force of the spring and to thus close the cover upon the body. Hence, the user often encounters the problem in closing the cover upon the body. If the downward pressing force of the cover exerted on the body is insufficient, the poor gear meshing between the motor gear and the transporting roller gear may cause the gear slippage. Also, the cover closing upon the body may produce an abrupt shock on the internal components of the feeder, thereby causing, eventually, shift of the mounting positions of these components and negative impact on the scan quality or the print quality.

SUMMARY OF THE INVENTION

Accordingly, the present invention has been proposed to solve the problems of the prior art, and it is an object of the present invention to provide an automatic feeder with separable transmission gears and an image acquiring apparatus using such automatic feeder. The operations of disengaging the gears from and engaging the gears with one another are carried out by the rotating of the cover to avoid the occurrence of the sudden shock and eliminate problems caused by poor gear meshing.

To achieve the above-identified object, the present invention provides an automatic feeder including a cover, a power-output gear, a roller gear, an actuating member and a middle gear. The cover is rotatably connected to a body through a first pin and openable and closable with respect to the body. The roller gear rotates a transporting roller to transport a sheet. The actuating member is attached to the first pin and driven by rotation of the first pin. The middle gear is displaceable by the actuating member and selectively engaged with both of the power-output gear and the roller gear so as to transmit a power to the roller gear. The actuating member moves the middle gear to be engaged with the power-output gear and the roller gear when the cover is closed upon the body. The actuating member moves the middle gear to be disengaged from at least one of the power-output gear and the roller gear when the cover is opened.

The present invention further provides an image acquiring apparatus for acquiring an image of the sheet, which includes the above-mentioned automatic feeder for feeding the sheet.

The gears, effectuated by rotation of the cover, can be disengaged from one another and engaged with one another to prevent the conventional problems from occurring.

Further scope of the applicability of the present invention will become apparent from the detailed description given hereinafter. However, it should be understood that the detailed description and specific examples, while indicating preferred embodiments of the present invention, are given by way of illustration only, since various changes and modifications within the spirit and scope of the present invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention.

DETAILED DESCRIPTION OF THE INVENTION

The present invention will be apparent from the following detailed description, which proceeds with reference to the accompanying drawings.

Figure 1:
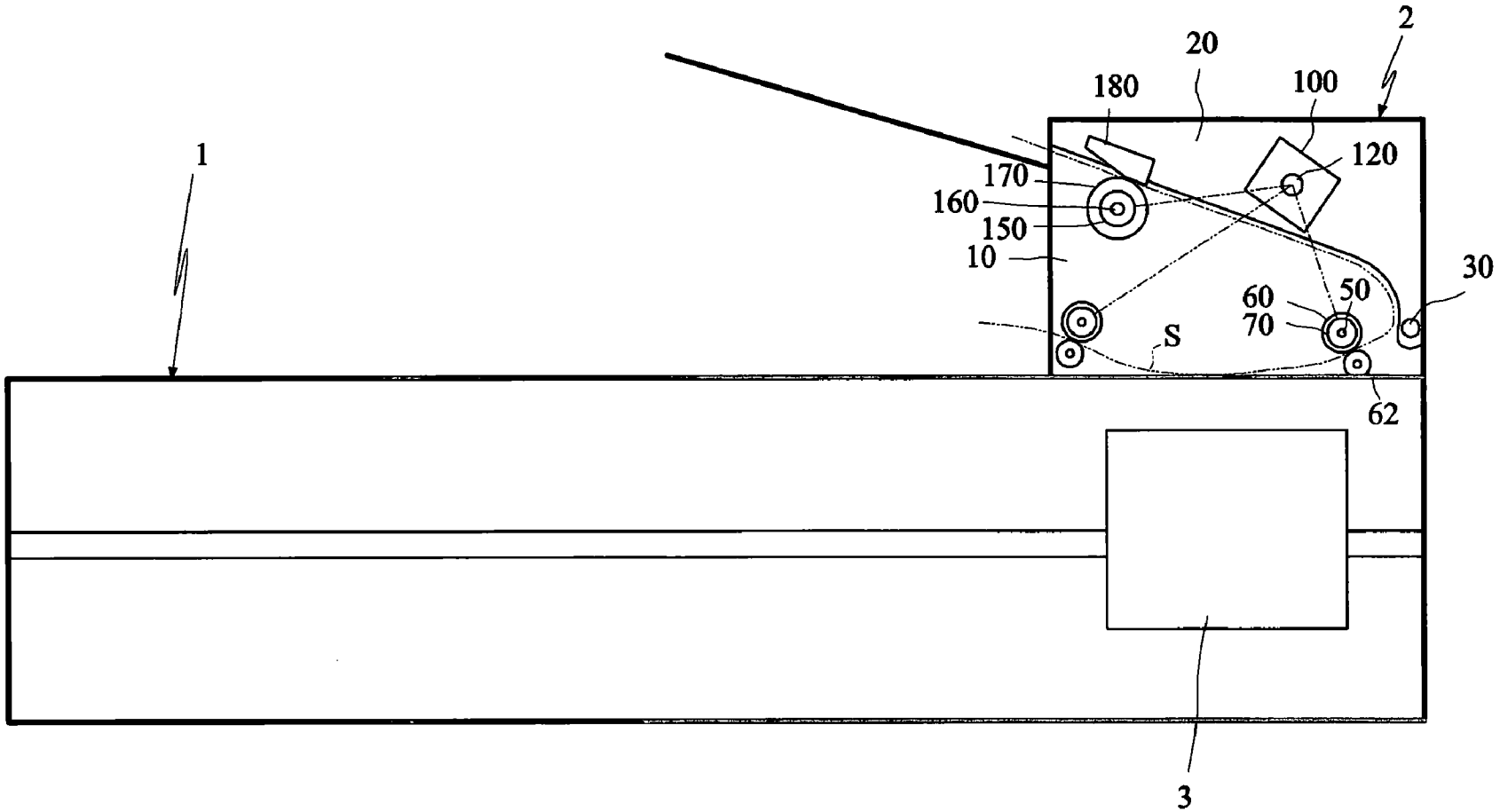
FIG. 1 is a schematic illustration showing an image acquiring apparatus according to a preferred embodiment of the present invention.

FIG. 1 is a schematic illustration showing an image acquiring apparatus 200 according to a preferred embodiment of the present invention. Referring to FIG. 1, the image acquiring apparatus 200 includes an automatic feeder 2 for feeding a sheet S, and an image acquiring unit 3 for acquiring an image of the sheet S. The image acquiring unit 3 is movably disposed in a housing 1 and the automatic feeder 2 is mounted on the housing 1.

Figure 2:
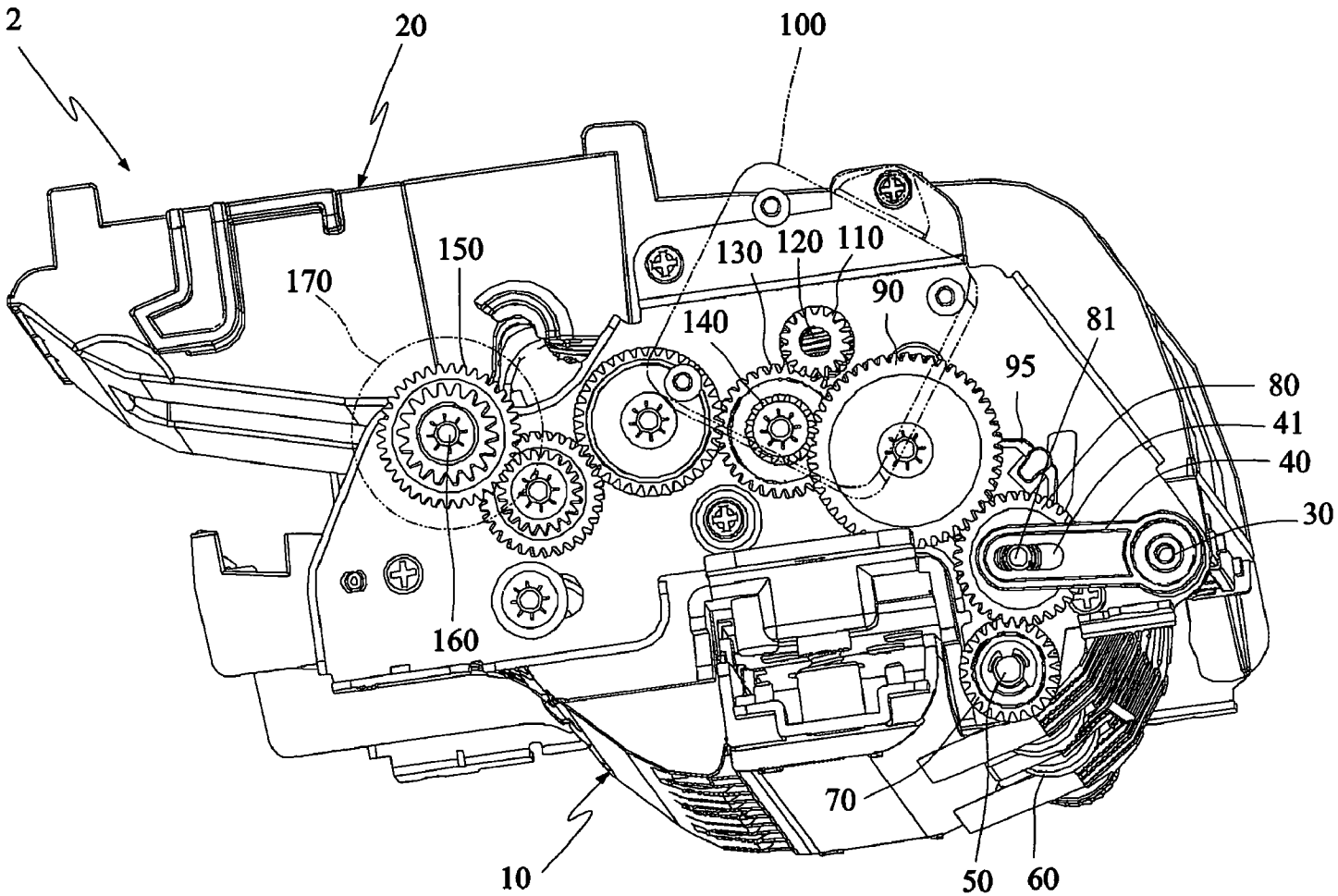
FIG. 2 is a pictorial view showing a closed state of a cover of the automatic feeder of FIG. 1.
Figure 3:
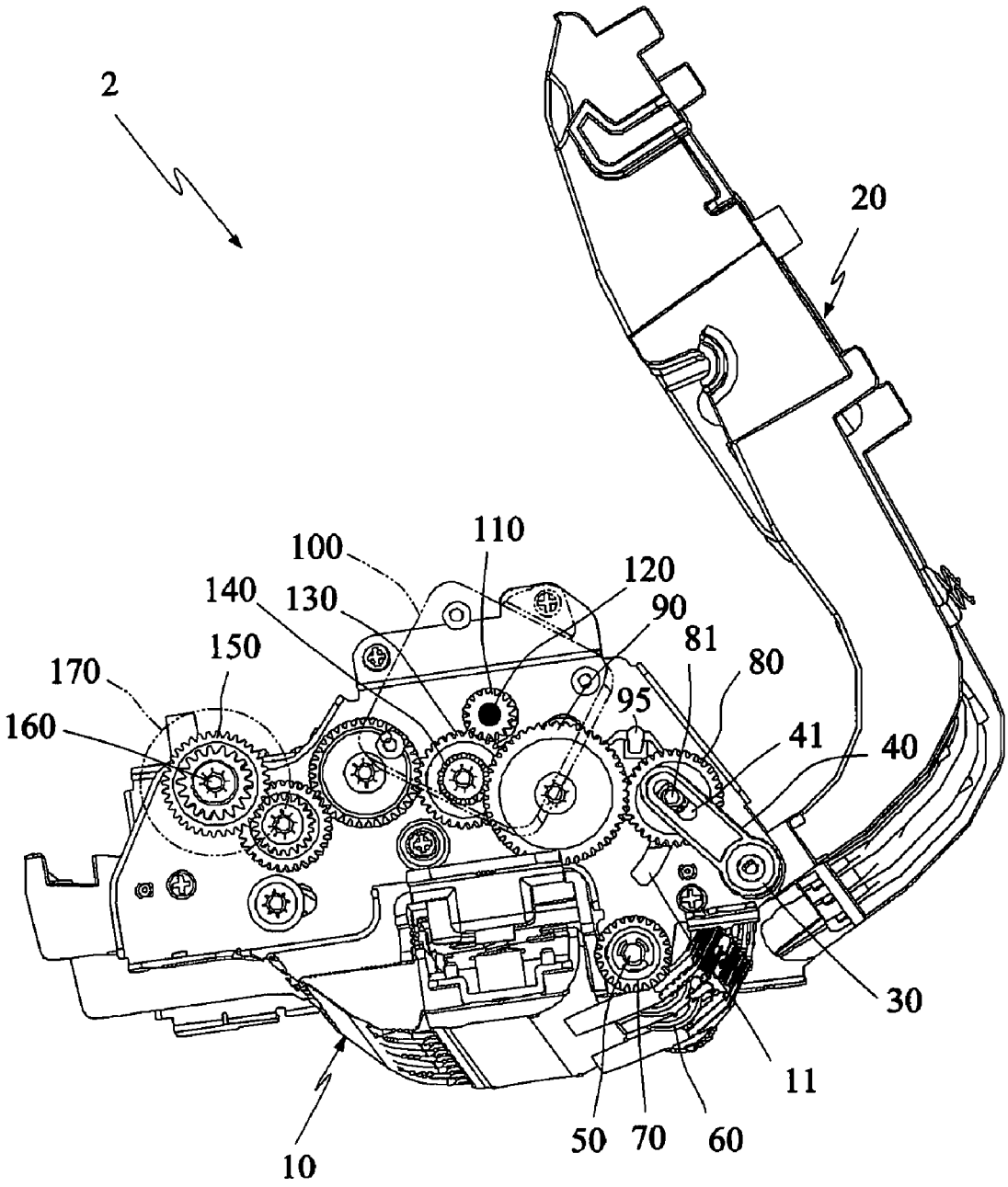
FIG. 3 is a pictorial view showing an open state of the cover of the automatic feeder of FIG. 1.

FIG. 2 is a pictorial view showing a closed state of a cover 20 of the automatic feeder 2 of FIG. 1. FIG. 3 is a pictorial view showing an open state of the cover 20 of the automatic feeder 2 of FIG. 1. Referring to FIGS. 1 to 3, the automatic feeder 2 includes the cover 20, a power-output gear 90, a roller gear 70, an actuating member 40 and a middle gear 80.

The cover 20 is rotatably connected to a body 10 through a first pin 30 and openable and closable with respect to the body 10, and the first pin 30 is rotated with the opening and closing of the cover 20. Usually, the user opens up the cover 20 to remove the jammed paper, and then closes the cover 20 upon the body 10 when having finished. In this embodiment, the first pin 30 is rotated when the cover 20 is opened and closed.

In this embodiment, the actuating member 40 is attached to the first pin 30 at one end and driven by rotation of the first pin 30, and the roller gear 70, mounted on a rotating shaft 50, rotates a transporting roller 60 to transport the sheet S. Usually, one transporting roller 60 or multiple transporting rollers 60 may be mounted on the rotating shaft 50, and one roller 62 or multiple rollers 62 (see FIG. 1) may cooperate with the transporting roller 60 to transport the sheet S. The middle gear 80 is movably mounted in the body 10.

The middle gear 80 is displaceable by the actuating member 40 and selectively engaged with both of the power-output gear 90 and the roller gear 70 so as to transmit a power to the roller gear 70.

In the normal state, the actuating member 40 moves the middle gear 80 to be engaged with the power-output gear 90 and the roller gear 70 when the cover 20 is closed upon the body 10, as shown in FIG. 2.

When paper jam is to be cleared, the cover 20 is opened and the actuating member 40 driven by the first pin 30 moves the middle gear 80 to be disengaged from at least one of the power-output gear 90 and the roller gear 70 when the cover 20 is opened, as shown in FIG. 3. In this embodiment, when the cover 20 is opened, the middle gear 80 is disengaged from the roller gear 70 and still meshed with the power-output gear 90; however, the present invention is not particularly restricted thereto. The middle gear 80 may as well be disengaged from the power-output gear 90 at the time when the middle gear 80 is disengaged from the roller gear 70, to achieve the purposes of breaking the connection of the power-output gear 90 and the roller gear 70 and facilitating the removal of the jammed paper.

Figure 4:
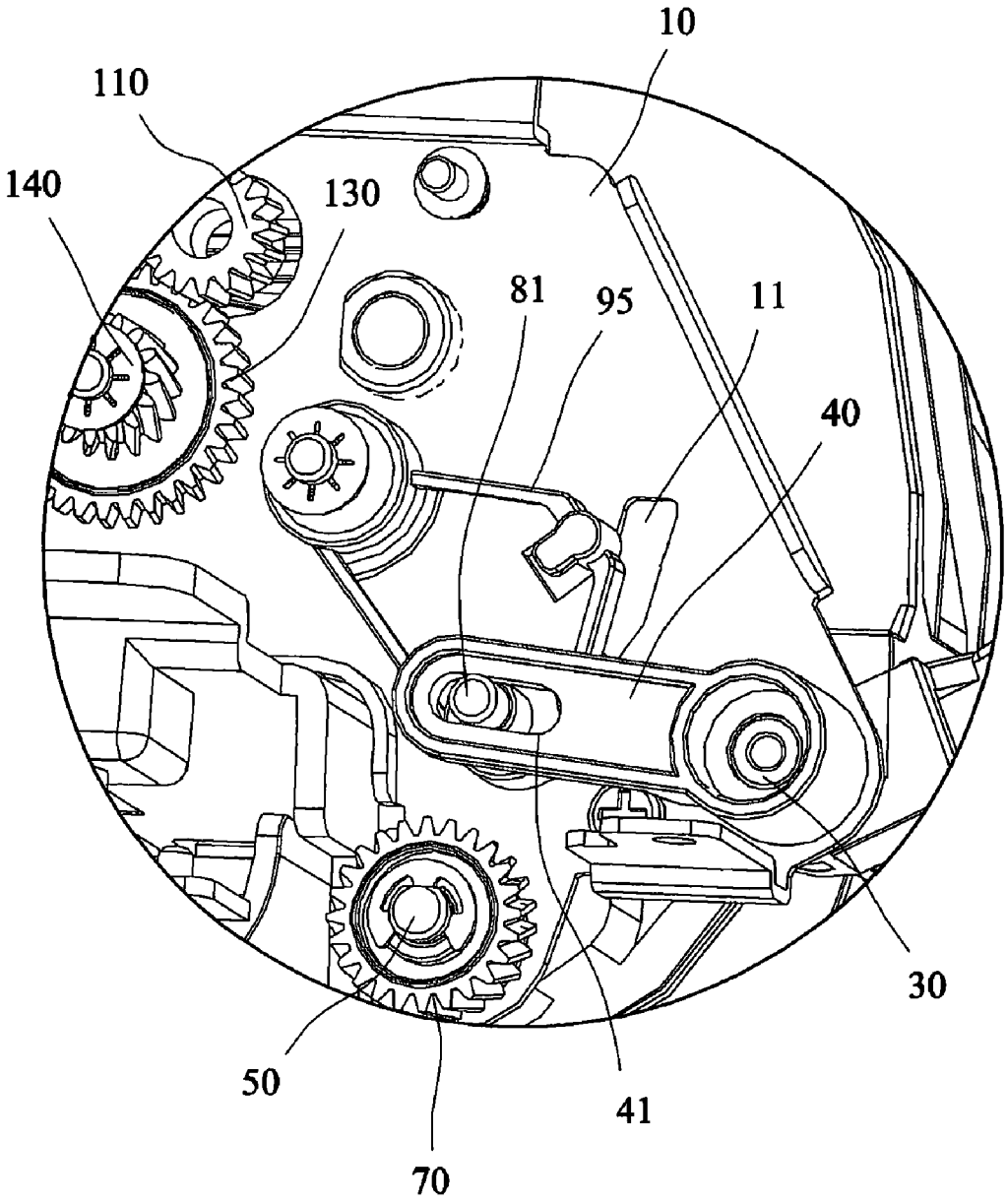
FIGS. 4 and 5 are enlarged partial views of the automatic feeders of FIGS. 2 and 3, respectively, omitting some of the gears.
Figure 5:
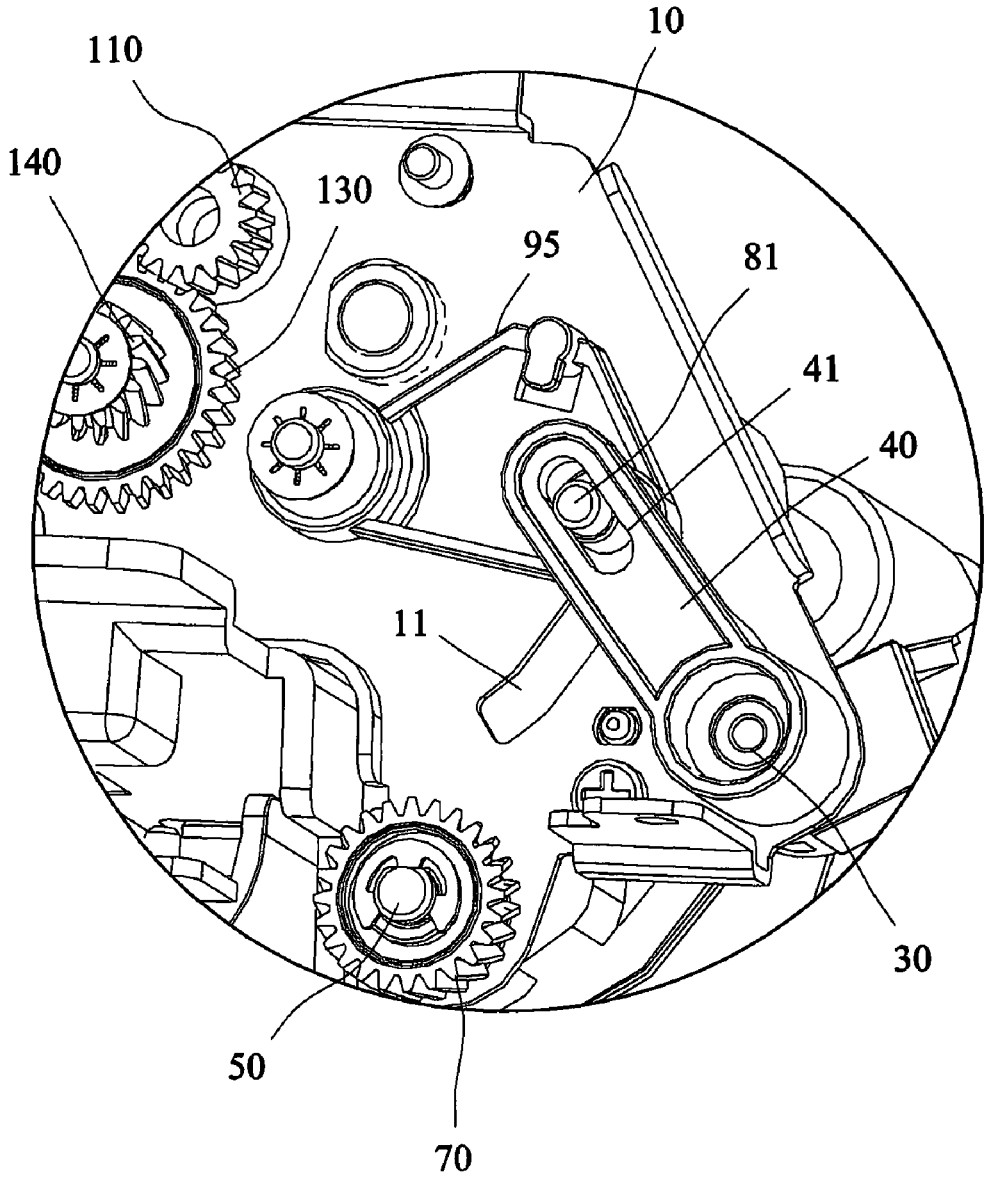

FIGS. 4 and 5 are enlarged partial views of the automatic feeders 2 of FIGS. 2 and 3, respectively, omitting some of the gears. As shown in FIG. 2 to 5, the automatic feeder 2 further includes a track 11 and a swingable holder 95. The track 11 in this embodiment is a groove formed on the body 10, but is not limited to this. The middle gear 80 is moved along the track 11. The swingable holder 95, pivotally mounted on the body 10, has a second pin 81 which holds the middle gear 80. The swingable holder 95 is driven to swing back and forth along the track 11 by the actuating member 40. In this embodiment, the swingable holder 95 and the power-output gear 90 are mounted coaxially. The actuating member 40 has an adjustment slot 41 for receiving the second pin 81, by which the actuating member 40 is connected to the middle gear 80. It is to be noted that the second pin 81 may project from two sides of the swingable holder 95 and is movably accommodated within the track 11 and the adjustment slot 41.

In addition, the automatic feeder 2 further includes a motor 100, a driving gear 110, a first gear 130, a second gear 140, a third gear 150, a separation roller shaft 160 and a separation roller 170, referring to FIGS. 1 to 3. The motor 100 is the mechanical power source of the automatic feeder 2. The driving gear 110 is mounted on an output shaft 120 of the motor 100. An output power of the motor 100 is transmitted to the roller gear 70 through the power-output gear 90 and the middle gear 80. The first gear 130 meshes with the driving gear 110. The second gear 140, disposed coaxially to the first gear 130, meshes with the power-output gear 90 to transmit the output power. In this embodiment, the second gear 140 and the first gear 130 are mounted coaxially. The separation roller shaft 160 is rotatably mounted in the body 10. The third gear 150, mounted on the separation roller shaft 160, receives the output power of the motor 100 through the first gear 130 and several gears (not labeled) to rotate the separation roller 170. The separation roller 170, mounted on the separation roller shaft 160, cooperates with a friction member 180, such as a friction pad (see FIG. 1), to carry out a sheet separation operation.

The relative motion of the cover 20 and the actuating member 40 will be described in the following with reference to FIGS. 2 to 5. As shown in FIGS. 3 and 5, when the cover 20 is opened with respect to the body 10, rotation of the cover 20 about the first pin 30 drives the actuating member 40 to rotate in a clockwise direction, so that the middle gear 80 is moved to a position where the power-output gear 90 is disconnected from the roller gear 70. As shown in FIGS. 2 and 4, when the cover 20 is closed upon the body 10, the cover 20 drives, through the first pin 30, the actuating member 40 to rotate in a counterclockwise direction, so that the middle gear 80 is moved to a position where the power-output gear 90 is connected with the roller gear 70. Thus, the operations of opening and closing the cover 20 compel the middle gear 80 to be engaged with or disengaged from the power-output gear 90 and the roller gear 70.

Figure 6:
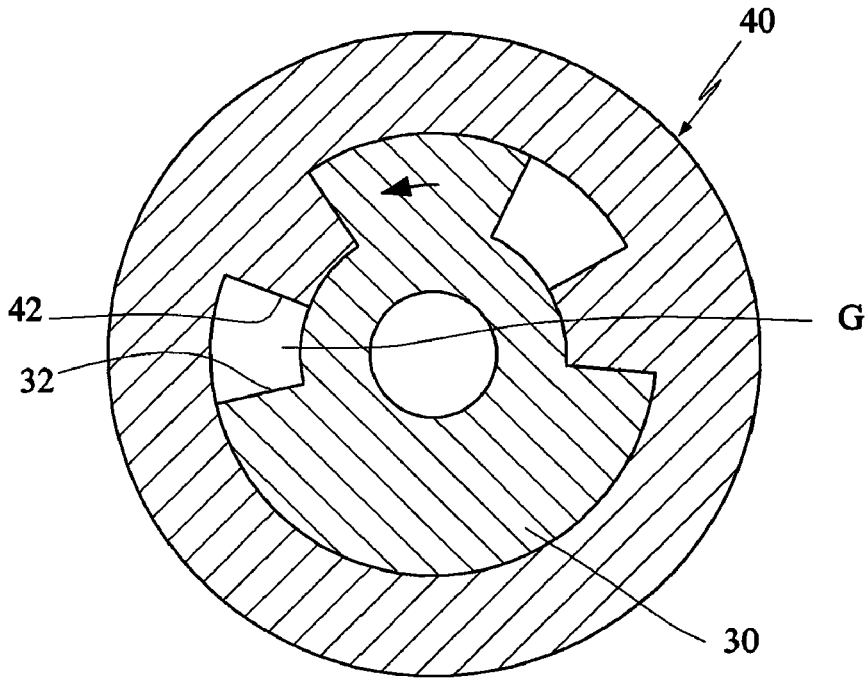
FIGS. 6 and 7 show two engagement states of the first pin with the actuating member of the present invention.
Figure 7:
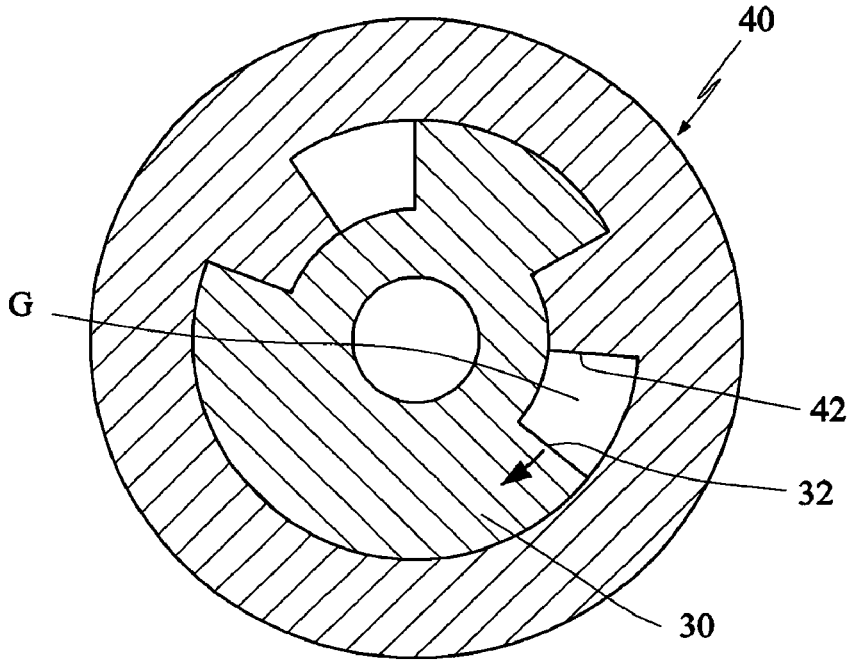

FIGS. 6 and 7 show two engagement states of the first pin 30 with the actuating member 40. Referring to FIGS. 6 and 7, an end of the actuating member 40 attached to the first pin 30 is fitted around the first pin 30. The first pin 30 includes first engagement parts 32 and the actuating member 40 includes second engagement parts 42. The first engagement parts 32 of the first pin 30 are rotated freely within the range of a gap G until they abut the second engagement parts 42 of the actuating member 40. Therefore, as shown in FIG. 7, when the cover 20 is opened with respect to the body 10, the first pin 30 freely rotates relatively to the actuating member 40 an angle defined by the gap G before engaging and driving the actuating member 40 to move in the clockwise direction, such that an open angle of the cover 20 is increased. The open angle of the cover 20 is increased because the gap G provides the cover 20 the freedom to open wider than the angle permitted by the distance travelled by the middle gear 80. As shown in FIG. 6, when the cover 20 is closed with respect to the body 10, the first pin 30 also freely rotates relatively to the actuating member 40 the angle defined by the gap G before engaging and driving the actuating member 40 to move in the counterclockwise direction The first pin 30 is connected to the cover 20, and the first pin 30 of the present invention may be formed integrally with the cover, and/or rotated synchronously with the cover 20. It is to be noted that the first engagement parts 32 and the second engagement parts 42 may have various structures for engagement and disengagement to carry out the above-mentioned function.

As described above, according to the present invention, the transmission gears are able to be separable from one another without any additional power applied, and instead, the opening and closing motion of the cover induce these gears to be disengaged from or engaged with one another. The cover of the present invention needs not to provide any additional locking force to overcome the separation force provided by the spring as in the prior art, and the feeder of the present invention is free from the problems of the improper closing of the cover and gear slippage.

While the present invention has been described by way of examples and in terms of preferred embodiments, it is to be understood that the present invention is not limited thereto. To the contrary, it is intended to cover various modifications. Therefore, the scope of the appended claims should be accorded the broadest interpretation so as to encompass all such modifications.

What is claimed is:

1. An automatic feeder, comprising:

a cover rotatably connected to a body through a first pin and openable and closable with respect to the body;

a power-output gear;

a roller gear for rotating a transporting roller to transport a sheet;

an actuating member, attached to the first pin and driven by rotation of the first pin; and a middle gear, displaceable by the actuating member, for being selectively engaged with both of the power-output gear and the roller gear so as to transmit a power to the roller gear, wherein:

the actuating member moves the middle gear to be engaged with the power-output gear and the roller gear when the cover is closed upon the body; and the actuating member moves the middle gear to be disengaged from at least one of the power-output gear and the roller gear when the cover is opened.

2. The automatic feeder according to claim 1, further comprising a track, wherein the middle gear is moved along the track.

3. The automatic feeder according to claim 2, further comprising a swingable holder, pivotally mounted, having a second pin for holding the middle gear, wherein the swingable holder is swung back and forth along the track by the actuating member.

4. The automatic feeder according to claim 3, wherein the actuating member has an adjustment slot for receiving the second pin, by which the actuating member is connected to the middle gear.

5. The automatic feeder according to claim 1, wherein an end of the actuating member attached to the first pin is fitted around the first pin with a gap between engagement parts of the actuating member and the first pin, and when the cover is opened with respect to the body, the first pin freely rotates relatively to the actuating member an angle defined by the gap before engaging and driving the actuating member to move, such that an open angle of the cover is increased.

6. The automatic feeder according to claim 1, further comprising:

a motor, wherein an output power of the motor is transmitted to the roller gear through the power-output gear and the middle gear.

7. The automatic feeder according to claim 6, further comprising a driving gear mounted on an output shaft of the motor.

8. The automatic feeder according to claim 7, further comprising:

a first gear meshing with the driving gear; and a second gear, disposed coaxially to the first gear, for meshing with the power-output gear to transmit the output power.

9. The automatic feeder according to claim 7, further comprising a third gear for receiving the output power of the motor through the first gear to rotate a separation roller.

10. The automatic feeder according to claim 1, wherein the first pin is rotated synchronously with the opening and closing of the cover.

11. An image acquiring apparatus, comprising:

an automatic feeder for feeding a sheet; and an image acquiring unit for acquiring an image of the sheet, wherein the automatic feeder comprises:

a cover rotatably connected to a body through a first pin and openable and closable with respect to the body;

a power-output gear;

a roller gear for rotating a transporting roller to transport the sheet;

an actuating member, attached to the first pin and driven by rotation of the first pin; and a middle gear, displaceable by the actuating member, for being selectively engaged with both of the power-output gear and the roller gear so as to transmit a power to the roller gear, wherein:

the actuating member moves the middle gear to be engaged with the power-output gear and the roller gear when the cover is closed upon the body; and the actuating member moves the middle gear to be disengaged from at least one of the power-output gear and the roller gear when the cover is opened.

12. The apparatus according to claim 11, wherein the automatic feeder further comprises a track, wherein the middle gear is moved along the track.

13. The apparatus according to claim 12, wherein the automatic feeder further comprises a swingable holder, pivotally mounted, having a second pin for holding the middle gear, wherein the swingable holder is swung back and forth along the track by the actuating member.

14. The apparatus according to claim 13, wherein the actuating member has an adjustment slot for receiving the second pin, by which the actuating member is connected to the middle gear.

15. The apparatus according to claim 11, wherein an end of the actuating member attached to the first pin is fitted around the first pin with a gap between engagement parts of the actuating member and the first pin, and when the cover is opened with respect to the body, the first pin freely rotates relatively to the actuating member an angle defined by the gap before engaging and driving the actuating member to move, such that an open angle of the cover is increased.

16. The apparatus according to claim 11, wherein the automatic feeder further comprises:

a motor, wherein an output power of the motor is transmitted to the roller gear through the power-output gear and the middle gear.

17. The apparatus according to claim 16, wherein the automatic feeder further comprises a driving gear mounted on an output shaft of the motor.

18. The apparatus according to claim 17, wherein the automatic feeder further comprises:

a first gear meshing with the driving gear; and a second gear, disposed coaxially to the first gear, for meshing with the power-output gear to transmit the output power.

19. The apparatus according to claim 17, wherein the automatic feeder further comprises a third gear for receiving the output power of the motor through the first gear to rotate a separation roller.

20. The apparatus according to claim 11, wherein the first pin is rotated synchronously with the opening and closing of the cover.

* * * * *